US010439289B2

(12) United States Patent
Ziv

(10) Patent No.: US 10,439,289 B2
(45) Date of Patent: Oct. 8, 2019

(54) WIDE-BAND ANTENNA

(71) Applicant: GALTRONICS USA, INC., Tempe, AZ (US)

(72) Inventor: Yaniv Ziv, Upper Tiberias (IL)

(73) Assignee: GALTRONICS USA, INC., Tempe, AZ (US)

( * ) Notice: Subject to any disclaimer, the term of this patent is extended or adjusted under 35 U.S.C. 154(b) by 561 days.

(21) Appl. No.: 15/046,988

(22) Filed: Feb. 18, 2016

(65) Prior Publication Data

US 2016/0248161 A1 Aug. 25, 2016

Related U.S. Application Data

(60) Provisional application No. 62/118,122, filed on Feb. 19, 2015.

(51) Int. Cl.
*H01P 5/10* (2006.01)
*H01Q 5/15* (2015.01)
(Continued)

(52) U.S. Cl.
CPC ..... *H01Q 9/26* (2013.01); *H01P 5/10* (2013.01); *H01Q 5/15* (2015.01); *H01Q 5/364* (2015.01);
(Continued)

(58) Field of Classification Search
CPC ..... H01Q 21/26; H01Q 21/28; H01Q 9/16; H01Q 9/18; H01Q 9/20; H01Q 9/26;
(Continued)

(56) References Cited

U.S. PATENT DOCUMENTS 3,210,768 A * 10/1965 Edward ..... H01Q 11/10 343/756
3,919,710 A * 11/1975 Fletcher ..... H01Q 9/42 343/770
(Continued)

FOREIGN PATENT DOCUMENTS

CN 2701094 Y 5/2005
CN 2881992 3/2007
(Continued)

OTHER PUBLICATIONS

The International Bureau of WIPO, International Preliminary Report on Patentability for International Application No. PCT/IB2016/050889 dated Aug. 31, 2017.
(Continued)

*Primary Examiner* — Dameon E Levi
*Assistant Examiner* — Jennifer F Hu
(74) *Attorney, Agent, or Firm* — Brion Raffoul

(57) ABSTRACT

A multiple-input multiple-output antenna is provided. The antenna may include, but is not limited to, at least one first dipole antenna including a first dipole arm, a second dipole arm, and a balun, the balun including a first bent conductive and a second bent conductive, and at least one second dipole antenna, the at least one second dipole antenna including a third dipole arm, a fourth dipole arm, a u-shaped balun galvantically coupled to the third dipole arm and the fourth dipole arm, a first conductive element galvanically isolated from the third dipole arm, the fourth dipole arm and the u-shaped balun, the first conductive element configured to capacitively couple to the third and fourth dipole arms, and a second conductive element galvanically connected to the u-shaped balun, the second conductive element configured to capacitively couple to the third dipole arm.

13 Claims, 4 Drawing Sheets

(51) Int. Cl.

| | |
|---|---|
| ***H01Q 9/20*** | (2006.01) |
| ***H01Q 9/26*** | (2006.01) |
| ***H01Q 21/06*** | (2006.01) |
| ***H01Q 21/24*** | (2006.01) |
| ***H01Q 21/28*** | (2006.01) |
| ***H01Q 25/00*** | (2006.01) |
| ***H01Q 5/364*** | (2015.01) |
| ***H01Q 5/378*** | (2015.01) |

(52) U.S. Cl.
CPC ..... *H01Q 5/378* (2015.01); *H01Q 21/062* (2013.01); *H01Q 21/24* (2013.01); *H01Q 21/28* (2013.01); *H01Q 25/001* (2013.01); *H01Q 9/20* (2013.01)

(58) Field of Classification Search
CPC ..... H01Q 9/285; H01Q 5/40; H01Q 5/42; H01Q 5/48; H01Q 19/108; H01Q 19/18; H01Q 19/20
See application file for complete search history.

(56) References Cited

U.S. PATENT DOCUMENTS 5,532,708 A * 7/1996 Krenz ..... H01Q 9/285 343/795
9,819,084 B2 * 11/2017 Zimmerman ..... H01Q 5/48
2009/0295667 A1 * 12/2009 Ma ..... H01Q 1/2225 343/795
2012/0146872 A1 * 6/2012 Chainon ..... H01Q 1/523 343/818
2013/0271345 A1 * 10/2013 Tang ..... H01Q 9/285 343/893
2014/0132469 A1 * 5/2014 Wang ..... H01Q 1/2266 343/821
2014/0327591 A1 * 11/2014 Kokkinos ..... H01Q 1/523 343/798
2018/0040955 A1 * 2/2018 Vouvakis ..... H01Q 9/285

FOREIGN PATENT DOCUMENTS

CN 2881992 Y * 3/2007
CN 102570011 7/2012
CN 102570011 A * 7/2012
CN 103947041 7/2014
CN 103947041 A * 7/2014 ..... H01Q 1/523

OTHER PUBLICATIONS

European Patent Office International Searching Authority, International Search Report and Writte Opinion for International Application No. PCT/IB2016/050889 dated Aug. 23, 2016.
Office Action received from the Chinese Patent Office dated Mar. 20, 2019.

* cited by examiner

WIDE-BAND ANTENNA

CROSS-REFERENCE TO RELATED APPLICATION(S)

This application claims the benefit of U.S. provisional patent application Ser. No. 61/118,122, filed Feb. 19, 2015, the entire content of which is incorporated by reference herein.

TECHNICAL FIELD

The present disclosure generally relates to antennas, and more particularly relates to a wide-band multiple-input multiple-output antenna.

BACKGROUND

Antennas are generally capable of resonating over a range of frequencies based upon a length of a resonant portion of the antenna. Generally, a dipole antenna is capable of resonating around plus and minus ten percent of a central frequency. In other words, a dipole antenna designed to resonate at, for example, 1 gigahertz would be resonant between 900 megahertz and 1.1 gigahertz and a dipole antenna designed to resonate at, for example, 5 gigahertz would be resonant between 4.5 and 5.5 gigahertz. Accordingly, communication devices which required an operable range of frequencies greater than operable range of a single dipole antenna were required to use multiple dipole antennas to cover the frequency range due to the limited resonant frequency range of the individual antennas.

BRIEF SUMMARY

In one embodiment, for example, a multiple-input multiple-output antenna is provided. The multiple-input multiple-output antenna may include, but is not limited to, at least one first dipole antenna configured to radiate within a first frequency range, the at least one first dipole antenna including, but not limited to, a first dipole arm, a second dipole arm, and a balun, the balun including, but not limited to, a first bent conductive element galvanically connected to the first dipole arm, and a second bent conductive element galvanically connected the second dipole arm and galvanically connected to the first bent conductive element, and at least one second dipole antenna configured to radiate within a second frequency range, the second frequency range being different than the first frequency range, the at least one second dipole antenna including, but not limited to a third dipole arm, a fourth dipole arm, a u-shaped balun galvantically coupled to the third dipole arm and the fourth dipole arm, a first conductive element galvanically isolated from the third dipole arm, the fourth dipole arm and the u-shaped balun, the first conductive element configured to capacitively couple to the third and fourth dipole arms, and a second conductive element galvanically connected to the u-shaped balun, the second conductive element configured to capacitively couple to the third dipole arm.

In another embodiment, for example, a multiple-input multiple-output antenna is provided. The multiple-input multiple-output antenna may include, but is not limited to, at least one dipole antenna configured to radiate within a first frequency range, the at least one dipole antenna including, but not limited to a first dipole arm, a second dipole arm, and a balun, the balun including, but not limited to a first bent conductive element galvanically connected to the first dipole arm, and a second bent conductive element galvanically connected the second dipole arm and galvanically connected to the first bent conductive element.

In yet another embodiment, for example, a multiple-input multiple-output antenna is provided. The multiple-input multiple-output antenna may include, but is not limited to, at least one dipole antenna configured to radiate within a frequency range, the at least one dipole antenna including, but not limited to, a first dipole arm, a second dipole arm, a u-shaped balun galvantically coupled to the first dipole arm and the second dipole arm, a first conductive element galvanically isolated from the first dipole arm, the second dipole arm and the u-shaped balun, the first conductive element configured to capacitively couple to the first and second dipole arms, and a second conductive element galvanically connected to the u-shaped balun, the second conductive element configured to capacitively couple to the first dipole arm.

BRIEF DESCRIPTION OF THE DRAWINGS

The detailed description will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or detail of the following detailed description.

Figure 1:
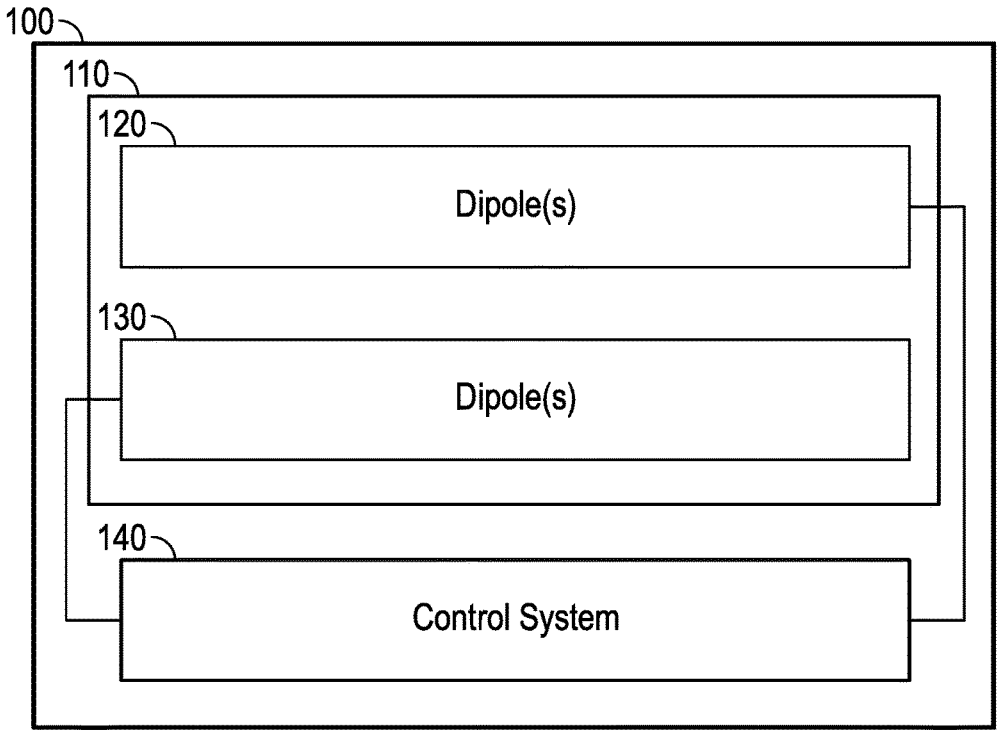
FIG. 1 is a block diagram of a multiple-input multiple-output (MIMO) antenna, in accordance with an embodiment.

FIG. 1 is a block diagram of a multiple-input multiple-output (MIMO) antenna 100, in accordance with an embodiment. The MIMO antenna 100 could be used as part of a communication system, for example, in a Wi-Fi communication system, a HSPA+ communication system, a WiMAX communication system, a long term evolution (LTE) communication system, or any other communication system, or combination thereof.

The MIMO antenna 100 includes a mounting surface 110. In one embodiment, for example, the mounting surface 110 may be a printed circuit board (PCB). In other embodiment, for example, the mounting surface may be a low loss dielectric surface, or the like. The mounting surface 110 may include one or more nonconductive layers and one or more conductive layers, which are not illustrated in FIG. 1. The conductive layers may include, for example, traces coupling the various components of the MIMO antenna 100.

At least one dipole antenna 120 configured to operate in a first frequency range and at least one dipole antenna 130 configured to operate in a second frequency range are mounted on the mounting surface 110. In one embodiment, for example, the MIMO antenna 100 may include an array of dipoles 120 and an array of dipoles 130. The arrays of dipoles 120 and 130 may be arranged as one or more sets of dipoles, each set of dipoles being arranged in a substantially square or diamond pattern, as discussed in further detail below.

In one embodiment, for example, the MIMO antenna 100 may further include a control system 140. The control system 140 may include, for example, a processor such as a central processing unit (CPU), an application specific integrated circuit (ASIC), a microcontroller, a field programmable gate array (FPGA), or any other logic device or combination thereof. The control system 140 may further include at least one radio unit controlled by the processor of the control system 140, the radio unit configured to provide a radio frequency (RF) signal to one or more of the dipoles 120 and 130. The control system 140 may be connected to the dipoles 120 and 130 via coaxial cables, traces on the conductive layer(s) of the mounting surface 110, phase shifters, RF switches, or any combination thereof.

Figure 2:
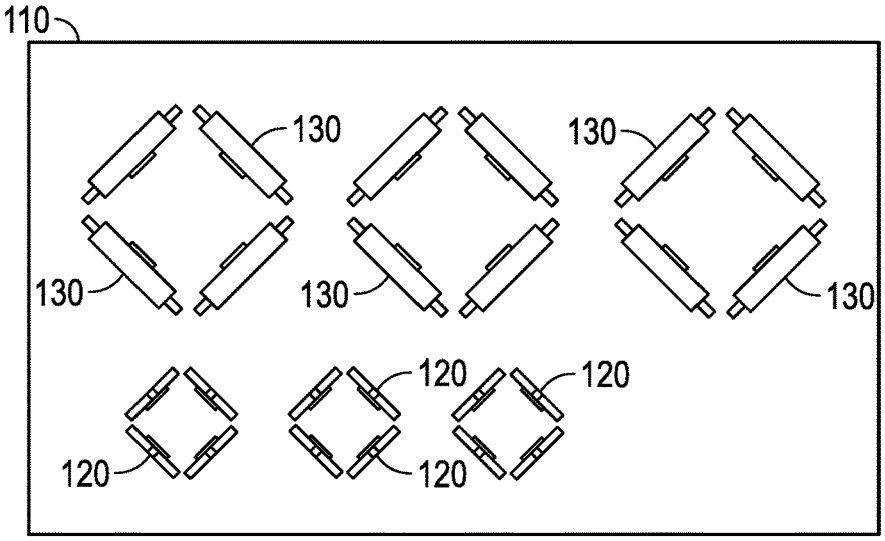
FIG. 2 illustrates an exemplary mounting surface for a MIMO antenna in accordance with an embodiment.

FIG. 2 illustrates an exemplary mounting surface 110 for a MIMO antenna 100 in accordance with an embodiment. As seen in FIG. 2 the exemplary MIMO antenna 100 includes twelve dipoles 120 and twelve dipoles 130. However, the number of dipoles 120 and 130 as well as their arrangement on the mounting surface 110 can vary.

In the embodiment illustrated in FIG. 2, the dipoles 120 are arranged into three sets of four dipoles 120. Each of the dipoles 120 in the set are arranged perpendicular to an adjacent dipole antenna 120 such that the set of dipoles 120 are in a quadrate formation. The quadrate formations illustrated in FIG. 2 are arranged such that each dipole antenna 120 is arranged at a forty-five degree angle relative to an edge of the mounting surface 110. In other words, each quadrate formation may be substantially diamond shaped such that the dipoles 120 have plus and minus 45 degree polarization. However, in other embodiments, for example, the quadrate formation of the dipoles 120 may be arranged square to the edges of the mounting surface such that the dipoles 120 have vertical and horizontal polarization.

In the embodiment illustrated in FIG. 2 the dipoles 130 are arranged in a similar manner as the dipoles 120. However, the number of dipoles 120 and the number of dipoles 130 and the formation of the dipoles 120 and 130 do not have to match. In other words, the MIMO antenna 100 could have any number of dipoles 120 and any number of dipoles 130 arranged in any formation on the mounting surface 110.

Figure 3:
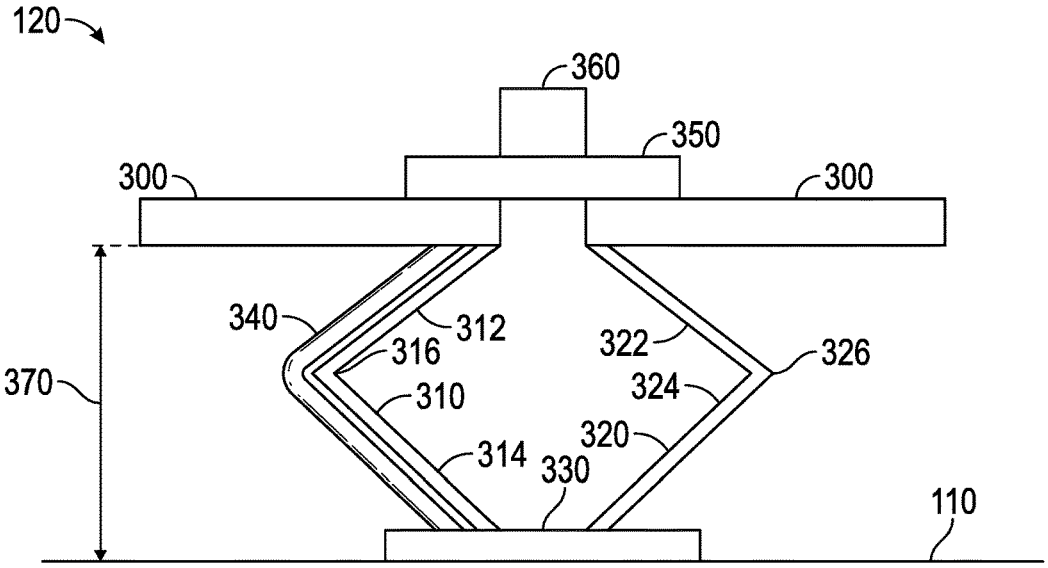
FIG. 3 is a side view of an exemplary dipole antenna, in accordance with an embodiment.

FIG. 3 is a side view of an exemplary dipole antenna 120, in accordance with an embodiment. The dipole antenna 120 includes dipoles arms 300. In the embodiment illustrated in FIG. 3, the dipole arms 300 are substantially straight conductive strips. However, in other embodiments, the dipole arms 300 may have bent end portions. The bent end portions shorten the actual length of the dipole arms 300 without shortening the electrical length of the dipole arms, thereby maintaining operation within the same frequency range while taking up less physical space. In one embodiment, for example, the dipole antenna 120 may be stamped, cut, or otherwise formed from a single conductive sheet. The dipole arms 300 may initially be formed to have a bent shape of any angle. However, in other embodiments, for example, the dipole arms may be formed straight and then bent to for the bent end portions. In yet other embodiments, for example, a combination of initial formation and subsequent bending may be used to form the shape of the dipole arms 300.

The dipole antenna 120 further includes bent conductive elements 310 and 320. In one embodiment, for example, the dipole antenna may further include a conductive base 330. In this embodiment, for example, the bent conductive element 310 couples one of the dipole arms 300 to the conductive base 330 and the bent conduct element 320 coupled the other dipole arm 300 to the conductive base 330. However, in another embodiment, for example, the bent conductive elements 310 and 320 may couple directly to each other rather than coupling through a conductive base 330. In this embodiment, for example, the dipole antenna 120 may include a non-conductive base which may be used as a mounting location for mounting the dipole antenna 120 to the mounting surface 110.

The total height of each of the bent conductive elements 310 and 320 is preferably equal such that the dipole arms 300 are parallel to the mounting surface 110. In one embodiment, for example, the total height of the bent conductive elements 310 and 320 and the conductive base 330, indicated by arrow 370, is $\frac{1}{4}\lambda$, where $\lambda$ is a wave length centered around a resonant frequency of the dipole arms 300. Accordingly, the distance of the dipole arms 300 from the mounting surface 110 of the MIMO antenna is $\frac{1}{4}\lambda$. This distance allows RF waves which are reflected off of the mounting surface 110 to be in phase with radio frequency waves emanating from the dipole arms 300.

The bent conductive elements 310 and 320 have respective portions 312, 322, 314 and 324 corresponding to the portion above and below bend points 316 and 326 for the bent conductive elements 310 and 320, respectively. As seen in FIG. 3, the bent conductive elements 310 and 320 may be formed asymmetrically. In other words, the physical length of the portions 312, 322, 314 and 324 may not be equal. However, in other embodiments, the bent conductive elements 310 and 320 may be formed symmetrically. By adjusting the lengths of the portions 312, 322, 314 and 324 of the conductive elements 310 and 320, the impedance of the dipole antenna 120 can be adjusted. Accordingly, the conductive elements 310 and 320 and the conductive base 330 function as a balun for the dipole antenna 120 such that the impedance of the dipole antenna 120 can match the impedance of a feed element 340 feeding the dipole antenna 120. In the embodiment illustrated in FIG. 3, the feed element 340 is a coaxial cable witch runs parallel to one of the conductive elements, in this example conductive element 310.

In one embodiment, for example, the portions 312 and 322 of the bent conductive elements 310 and 320 may each have an electrical length of $\frac{1}{4}\lambda$. When the dipole arms 300 receive a feed signal from the feed element 340, the signal travels the length of the portions 312 and 322 of the bent conductive elements 310 and 320. Because the portions 312 and 322 of the bent conductive elements 310 and 320 have an electrical length of $\frac{1}{4}\lambda$, the portions 314 and 324 of the bent conductive elements 310 and 320 appear to be an open circuit to the feed signal from the feed element 340. When RF signal reach a discontinuity, such as an open circuit, a portion of the RF signals may be radiated. Accordingly, the portions 312 and 322 of the bent conductive elements 310 and 320 act as an additional antenna element radiating within a frequency range dependent upon the electrical length of the respective portions 312 and 322. Similar points of discontinuity can be observed in different locations of the structure 312,322,314,324. In one embodiment, for example, the electrical lengths of the portions 312 and 322 of the bent conductive elements 310 and 320 may be selected to be different. In this embodiment, each of the portions 312 and 322 of the bent conductive elements 310 and 320 may radiate within different frequency ranges, thereby further broadening the operable frequency range of the dipole antenna 120.

In one embodiment, for example, the length of the dipole arms 300 may be selected such that the dipole antenna 120 operates within a frequency range of around 1.7-2.2 gigahertz (GHz). Accordingly, in this embodiment the dipole antenna 120 radiates around a center frequency of around 1.9 GHZ by around sixteen percent. In other words, the bandwidth of the dipole antenna 120, without taking into consideration the portions 312 and 322 of the bent conductive elements 310 and 320, operates within a band spanning 1.9 GHZ +/−(~0.16*1.9 GHz). When the portions 312 and 322 of the bent conductive elements 310 and 320 are taken into account, the dipole antenna 120 is capable of operating in a frequency band spanning around 1.690 GHZ to 2.7 GHz. Accordingly, in this embodiment the dipole antenna 120 radiates around a center frequency of around 2.2 GHZ by around twenty-two percent, increasing the bandwidth of the antenna. In other words, the bandwidth of the dipole antenna 120, when taking into consideration the portions 312 and 322 of the bent conductive elements 310 and 320, operates within a band spanning 2.2 GHZ +/−(~0.22*2.2 GHz). Accordingly, the portions 312 and 322 of the bent conductive elements 310 and 320 allow each dipole antenna 120 to operate over a much wider range. As discussed above, a typical dipole antenna is only resonant over a +/−five percent range, whereas the exemplary dipole antenna 120 discussed herein is resonant over a +/−twenty-two percent range.

In one embodiment, for example, the dipole antenna 120 further includes a non-conductive cap 350. The non-conductive cap 350 may be formed from a plastic or any other insulative material. The dipoles arms 300 of the dipole antenna 120 can be connected to the non-conductive cap 350 via one or more of a friction fit, glue, screws, bolts, or the like. The non-conductive cap 350 may, for example, help maintain the dipole arms in a predetermined position.

In one embodiment, for example, the dipole may further include a conductive cap 360 mounted on the non-conductive cap 350. The conductive cap 360 may be formed from any conductive material. The conductive cap 360 may be affixed to the non-conductive cap 350 via one or more of a friction fit, glue, screws, bolts, or the like. A feed line from the feed element 340 may be coupled to the conductive cap 360 such that the conductive cap 360 receives the same RF signal from the control system 140 as the dipole arms. The shape of the conductive cap 360 can be modified to adjust an impedance of the dipole antenna 120. Accordingly, the conductive cap 360 assists the bent conductive elements 310 and 320 in matching the impedance of the dipole antenna 120 to the impedance of the feed element 340. The addition of the conductive cap 360 to the dipole antenna 120 can improve the voltage standing wave ratio (VSWR) of the dipole antenna to 1.5 or less, depending upon the shape of the conductive cap 360.

Figure 4:
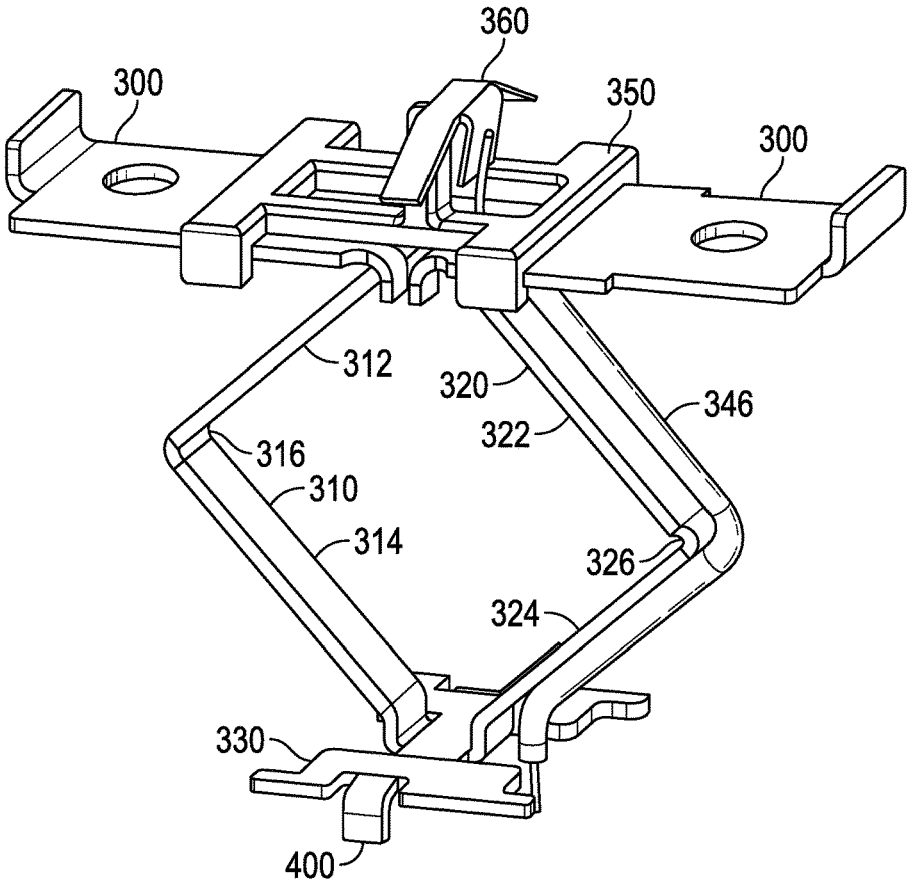
FIG. 4 is a perspective view of another exemplary dipole antenna, in accordance with an embodiment.

FIG. 4 is a perspective view of another exemplary dipole antenna 120, in accordance with an embodiment. The conductive cap 360 illustrated in FIG. 4 is substantially plus (i.e. "+") shaped), with the arms of the plus being bent. The bending of the arms of the conductive cap 360 allows for the impedance of the dipole 120 to be adjusted. Accordingly, the conductive cap 360 can be considered as coupling element between the dipole arms 300, or, in other words a frequency variable gap between the dipole arms 300.

FIG. 4 also illustrates one possible embodiment of dipole arms 300, bent conductive elements 310 and 320, conductive base 330, a feed element 340 and a non-conductive cap 350. As seen in FIG. 4, the dipole arms 300 include bent portions at both ends of the dipole arms, forming a substantially s-shaped element. As discussed above, by bending the dipole arms the physical length of the dipole arms can be reduced, decreasing the overall size of the antenna, without reducing the effective electrical length, and thus operating frequency, of the antenna.

The conductive base 330 illustrated in FIG. 4 includes a bent portion 400. The bent portion can be inserted into a corresponding hole in the mounting surface 110 thereby allowing the dipole antenna 120 to be aligned as desired on the mounting surface.

Figure 5:
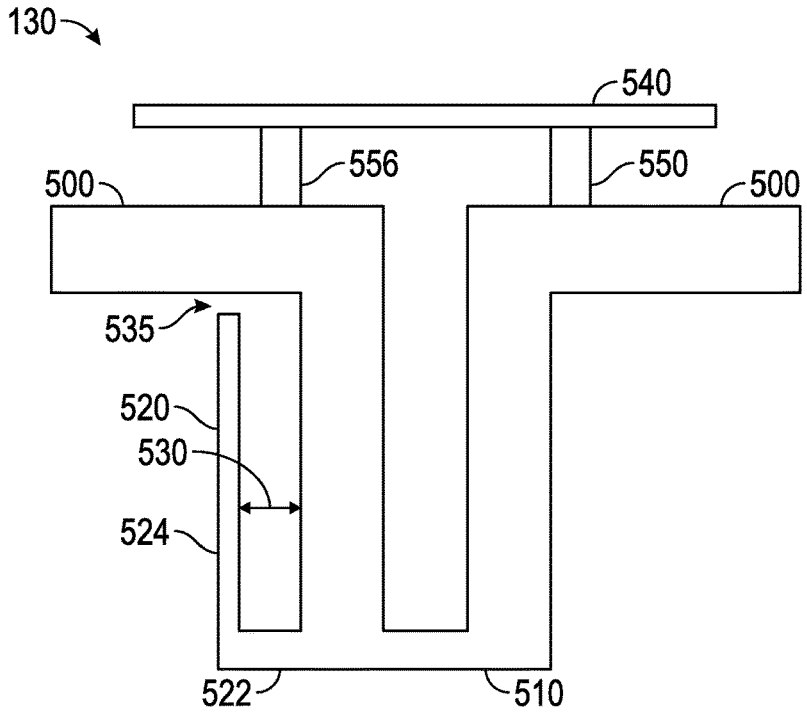
FIG. 5 is a side view of an exemplary dipole antenna, in accordance with an embodiment

FIG. 5 is a side view of an exemplary dipole antenna 130, in accordance with an embodiment. The dipole antenna 130 includes dipole arms 500. In the embodiment illustrated in FIG. 5, the dipole arms are substantially straight conductive strips. However, in other embodiments, the dipole arms 500 may have bent end portions. The bent end portions shorten the actual length of the dipole arms 500 without shortening the electrical length of the dipole arms 500, thereby maintaining operation within the same frequency range while taking up less physical space.

The dipole antenna 130 further includes a balun 510. The balun 510 is a substantially U-shaped conductive portion of the dipole antenna 130. The balun 510 allows connection of the symmetric dipole antenna 130 to a non-symmetric feed element (not illustrated). The feed element may be, for example, a coaxial cable or other conductive elements which are connected to the control system 140.

The dipole further includes a conductive element 520. The conductive element 520 is substantially L-shaped and includes a portion 522 and a portion 524 substantially perpendicular to the portion 522. As seen in FIG. 5, the portion 522 is parallel to the dipole arms 500 and perpendicular to an arm of the balun 510 and the portion 524 is perpendicular to the dipole arms 500 and parallel to an arm of the balun 510. The portion 522 of the conductive element 520 is galvanically connected to the balun 510 towards the bottom of the dipole antenna 130. In one embodiment, for example, the distance between the dipole arm 500 and the portion 522 is around ¼λ.

As seen in FIG. 5, the portion 524 of the conductive element 520 is separated from the balun 510 by a distance indicated by arrow 530 and is separated from the dipole arm 300 by a distance indicated by arrow 535. In one embodiment, for example, the distance indicated by arrow 530 may be 9 mm, and the distance indicated by arrow 535 may be between 2.6 and 3.0 mm. The conductive element 520 capacitively couples to the dipole arm 300 through the gap indicated by arrow 535 and to the balun 510 through the gap indicated by arrow 530 when the dipole is fed a feed signal from the control system 140. In one embodiment, for example, the conductive element 520 may have an electrical length of around 54 mm. The function of conductive element 220, however, is not to radiate because the polarization would be perpendicular to radiation of dipole arms 500. The capacitive coupling to the dipole arm 300 through the gap indicated by arrow 535 and to the balun 510 through the gap indicated by arrow 530 when the dipole is fed a feed signal from the control system 140 increases a bandwidth of the dipole arms 500.

The dipole antenna 130 further includes a conductive strip 540. The conductive strip 540 is coupled to the dipole arms via mounting elements 550. The mounting elements 550 may be constructed from a non-conductive material, such as plastic or the like, to galvanically isolate the conductive strip 540 from the dipole arms 500. The mounting elements 550 may be attached to the dipole arms and the conductive strip with, for example, screws, bolts, glue, or the like.

The conductive strip 540 capacitively couples to the dipole arms 500 when the dipole arms 500 are fed a feed signal from the control system 140. The capacitive coupling causes the conductive strip 540 to radiate in a frequency band dependent upon an electrical length of the conductive strip 540. In one embodiment, for example, the conductive strip may have an electrical length of around 130 mm. Accordingly, in this embodiment the conductive strip 540 may radiate within a frequency range of around 900-1100 MHz.

The dipole arms 500 may have, for example, a natural resonant frequency range of 694-900 MHz. The addition of the conductive element 520 allows the dipole antenna 130 to operate in a frequency range of 694-920 MHz. The further addition of the conductive strip 540 allows the dipole antenna to operate in a frequency range of 694-960 MHz. Accordingly, the conductive strips 520 and 540 increase the bandwidth of the dipole antenna 130 by around 29% percent.

Figure 6:
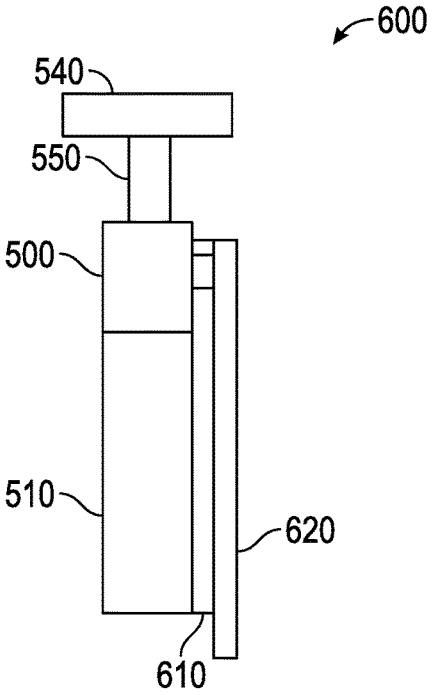
FIG. 6 illustrates a side view of an exemplary dipole antenna with an exemplary feed element, in accordance with an embodiment.

FIG. 6 illustrates a side view of an exemplary dipole antenna 130 with an exemplary feed element 600, in accordance with an embodiment. The dipole antenna 130 illustrated in FIG. 6 includes dipole arms 500, a balun 510, a conductive element 520 (not illustrated in FIG. 6), a conductive strip 540 and mounting elements 550, as discussed above.

The dipole antenna 130 further includes a feed element 600 including isolative layer 610 and a conductive feed layer 620. The isolative layer 610 is coupled to one side of the balun 510. In other words, the isolative layer 610 may be in a plane parallel to a plane the balun 510 is located in. However, the isolative layer 610 may also include a portion parallel to the mounting surface 110, and, thus may be used to mount the dipole antenna 130 to the mounting surface 110. The isolative layer 610 isolates the balun 510 from the conductive feed layer 620. In one embodiment, for example, the isolative layer 610 may be formed from a plastic, or any other insulative material.

In one embodiment, for example, the isolative layer 610 may be fixed to the balun 510 via a friction fit. In this embodiment, for example, one of the balun 510 and the isolative layer 610 may include projections and the other of the balun 510 and the isolative layer 610 may include inclusions corresponding to the projections. In another embodiment, for example, the isolative layer 610 may be fixed to the balun 510 via glue plastic screws, or the like.

The conductive feed layer 620 is coupled to the isolative layer 610. In one embodiment, for example, the conductive feed layer 620 may be fixed to the isolative layer 610 via a friction fit. In this embodiment, for example, one of the conductive feed layer 620 and the isolative layer 610 may include projections and the other of the conductive feed layer 620 and the isolative layer 610 may include inclusions corresponding to the projections. In another embodiment, for example, the isolative layer 610 may be fixed to the conductive feed layer 620 via glue, plastic screws, or the like.

As seen in FIG. 6, the conductive feed layer 620 is coupled to the dipole arms 500 to provide a feed signal to the dipole arms 500. In one embodiment, for example, the conductive feed layer 620 may be soldered to the dipole arms 500. However, any type of conductive coupling may be used to couple the conductive feed layer 620 to the dipole arms 500. The long lower section of the conductive feed layer 620 acts as a strip line against the metal (parallel to 510) on opposite side of insulator 610, 510 is connected to the ground.

Figure 7:
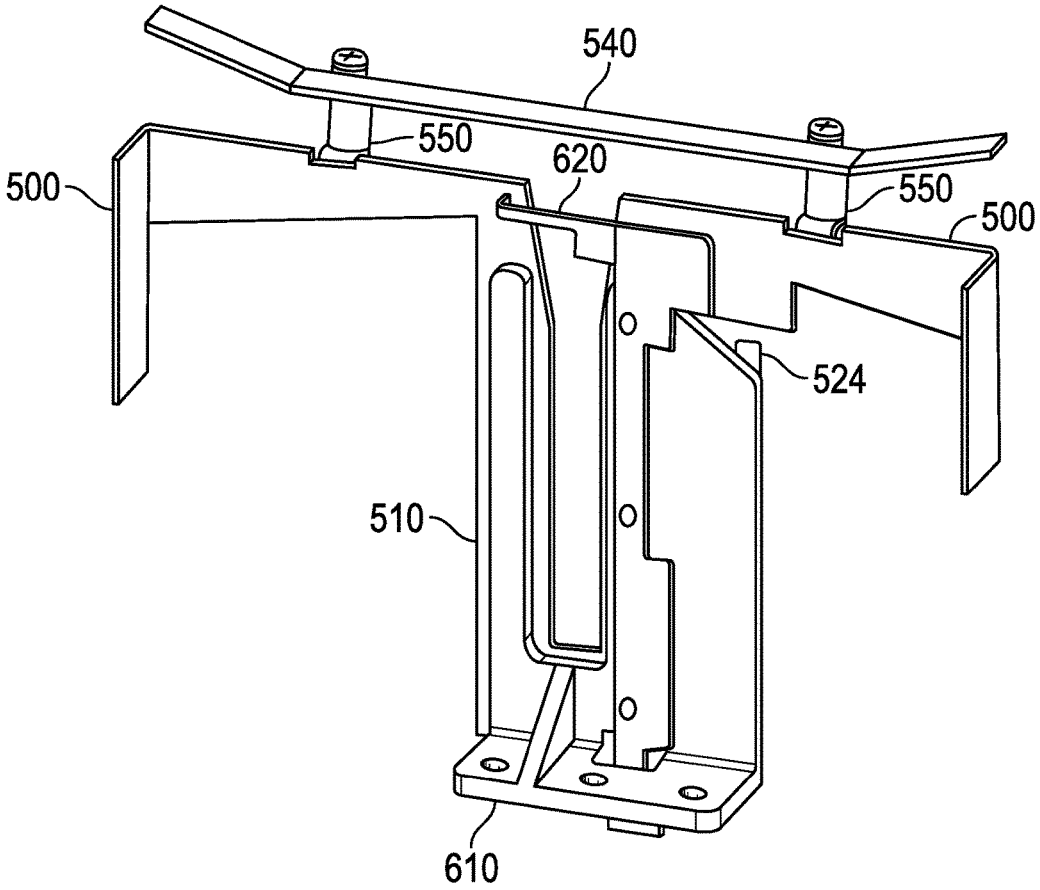
FIG. 7 is a perspective view of another exemplary dipole antenna, in accordance with an embodiment.

FIG. 7 is a perspective view of another exemplary dipole antenna 130, in accordance with an embodiment. The dipole antenna 130 illustrated in FIG. 7 includes dipole arms 500. The dipole arms 500 illustrated in FIG. 7 include end portions 505. In this embodiment, the dipole arms 500 may be formed substantially L-shaped. The L-shape shorts the actual length of the dipole arms 500 without shortening the electrical length of the dipole arms 500. The end portions 505 may then be bent such that a portion of the L-shaped dipole arms is perpendicular to the portion of the dipole arms 500 connected to the balun 510. The bend further reduces the actual length of the dipole arms 500 without shortening the electrical length, thereby maintaining operation within the same frequency range while taking up less physical space.

In the embodiment illustrated in FIG. 7, the conductive element 540 includes outer bent portions. By bending one or more portions of the conductive element, tuning of the capacitive coupling between the conductive element 540 and the dipole arms 500 can be achieved. In the embodiment illustrated in FIG. 7, the dipole arms each include a tapered portion. The shape of the dipole arms 500, however, can be modified in a number of ways to shorten the physical length of the dipole arms while providing a wide bandwidth.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A multiple-input multiple-output antenna, comprising:

at least one first dipole antenna configured to radiate within a first frequency range, the at least one first dipole antenna comprising:

a first dipole arm, a second dipole arm, and a balun, the balun comprising:

a first bent conductive element galvanically connected to the first dipole arm, comprising:

a first lower conductive portion; and a first upper conductive portion, the first lower conductive portion and the first upper conductive portion meeting at an angle, and a second bent conductive element galvanically connected the second dipole arm and galvanically connected to the first bent conductive element, comprising:

a second lower conductive portion; and a second upper conductive portion, the second lower conductive portion and the second upper conductive portion meeting at an angle, wherein at least one of the first upper conductive portion and the second upper conductive portion has an electrical length of ¼λ, where λ is a wavelength of a resonant frequency within the frequency range of the at least one first dipole antenna, and at least one second dipole antenna configured to radiate within a second frequency range, the second frequency range being different than the first frequency range, the at least one second dipole antenna comprising:

a third dipole arm, a fourth dipole arm, a u-shaped balun galvanically coupled to the third dipole arm and the fourth dipole arm, a first conductive element galvanically isolated from the third dipole arm, the fourth dipole arm and the u-shaped balun, the first conductive element configured to capacitively couple to the third and fourth dipole arms, and a second conductive element galvanically connected to the u-shaped balun, the second conductive element configured to capacitively couple to the third dipole arm.

2. The multiple-input multiple-output antenna of claim 1, further comprising a mounting surface, the at least one first dipole and the at least one second dipole being mounted to the mounting surface, wherein a distance between the first and second dipole arms and the mounting surface is ¼λ.

3. The multiple-input multiple-output antenna of claim 2, wherein the first lower conductive portion and the second lower conductive portion have different lengths.

4. The multiple-input multiple-output antenna of claim 1, wherein the at least one first dipole further comprises:

a non-conductive cap, the non-conductive cap mechanically coupling the first dipole arm to the second dipole arm; and a conductive cap mechanically coupled to the non-conductive cap, the non-conductive cap galvanically isolating the conductive cap from the first and second dipole arms, the conductive cap configured to capacitively couple to the first and second dipole arms.

5. The multiple-input multiple-output antenna of claim 1, wherein the at least one second dipole further comprises:

a isolative layer coupled to the u-shaped balun of the at least one second dipole; and a conductive feed layer coupled to the isolative layer, the conductive feed layer galvanically connected to the third dipole arm.

6. The multiple-input multiple-output antenna of claim 1, wherein the second conductive element is substantially L-shaped, and comprises:

a first portion parallel to the third and fourth dipole arms galvanically connected to a bottom of the U-shaped balun; and a second portion perpendicular to the third and fourth dipole arms galvanically coupled to the first portion.

7. The multiple-input multiple-output antenna of claim 6, wherein the second portion of the second conductive element is separated from the U-shaped balun by a distance of 9 millimeters.

8. The multiple-input multiple-output antenna of claim 6, wherein the second portion of the second conductive element is separated from the third dipole arm by a distance of 3 millimeters.

9. The multiple-input multiple-output antenna of claim 6, wherein the second portion of the second conductive element is separated from the U-shaped balun by a distance of 9 millimeters and the second portion of the second conductive element is separated from the third dipole arm by a distance of 3 millimeters.

10. A multiple-input multiple-output antenna, comprising:

at least one dipole antenna configured to radiate within a first frequency range, the at least one dipole antenna comprising:

a first dipole arm, a second dipole arm, and a balun, the balun comprising:

a first bent conductive element galvanically connected to the first dipole arm, comprising:

a first lower conductive portion; and a first upper conductive portion, the first lower conductive portion and the first upper conductive portion meeting at an angle, and a second bent conductive element galvanically connected the second dipole arm and galvanically connected to the first bent conductive element, comprising:

a second lower conductive portion; and a second upper conductive portion, the second lower conductive portion and the second upper conductive portion meeting at an angle, wherein at least one of the first upper conductive portion and the second upper conductive portion has an electrical length of ¼λ, where λ is a wavelength of a resonant frequency within the frequency range of the at least one first dipole antenna.

11. The multiple-input multiple-output antenna of claim 10, further comprising a mounting surface, the at least one dipole being mounted to the mounting surface, wherein a distance between the first and second dipole arms and the mounting surface is ¼λ.

12. The multiple-input multiple-output antenna of claim 11, wherein the first lower conductive portion and the second lower conductive portion have different lengths.

13. The multiple-input multiple-output antenna of claim 10, wherein the at least one dipole further comprises:

a non-conductive cap, the non-conductive cap coupling the first dipole arm to the second dipole arm; and a conductive cap coupled to the non-conductive cap, the non-conductive cap galvanically isolating the conductive cap from the first and second dipole arms, the conductive cap configured to capacitively couple to the first and second dipole arms.

* * * * *